US005911652A

United States Patent [19]

Jackson

[11] Patent Number: 5,911,652

[45] Date of Patent: Jun. 15, 1999

[54] ROLL-BACK EXERCISER

[76] Inventor: Benjamin F. Jackson, 2417 Lake St., Evanston, Ill. 60201

[21] Appl. No.: 08/984,137

[22] Filed: Dec. 3, 1997

[51] Int. Cl.[6] ..... A63B 21/02

[52] U.S. Cl. ..... 482/121; 482/126; 482/139

[58] Field of Search ..... 482/23, 25, 44–46, 482/91, 92, 121–123, 126, 131, 132, 139, 142, 148, 907; D21/679, 684

[56] References Cited

U.S. PATENT DOCUMENTS

| | | | |
|---|---|---|---|
| 192,338 | 6/1877 | Marshall | 482/126 |
| 4,863,159 | 9/1989 | Brown, Jr. | 482/126 |
| 5,026,050 | 6/1991 | Leung et al. | 482/126 |
| 5,074,549 | 12/1991 | Harvey | 601/33 |
| 5,342,273 | 8/1994 | Plendl et al. | 482/126 |
| 5,533,950 | 7/1996 | Lochbaum | 482/51 |

FOREIGN PATENT DOCUMENTS

| | | | |
|---|---|---|---|
| 532943 | 9/1931 | Germany | 482/126 |
| 2031285 | 4/1980 | United Kingdom | 482/122 |

*Primary Examiner*—Jeanne M. Clark
*Attorney, Agent, or Firm*—Paul H. Gallagher

[57] ABSTRACT

A rectangular frame made up entirely of tubes and tubular connectors, and glue securing them together. The tubes are self-biased to straight shape, thus self-biasing the frame to a position lying in a common plane. The frame includes end members made up of longitudinally spaced elements, and the frame may have selectively two, or three longitudinal members.

4 Claims, 2 Drawing Sheets

(4) 3/4" ELBOWS
(6) 3/4" TEES
(3) 4" LG. X 3/4" TUBES
(2) 12-1/2" LG. X 3/4" TUBES
(4) 6-1/4" LG. X 3/4" TUBES
(4) 1-1/2" LG. X 3/4" TUBES

Fig. 2
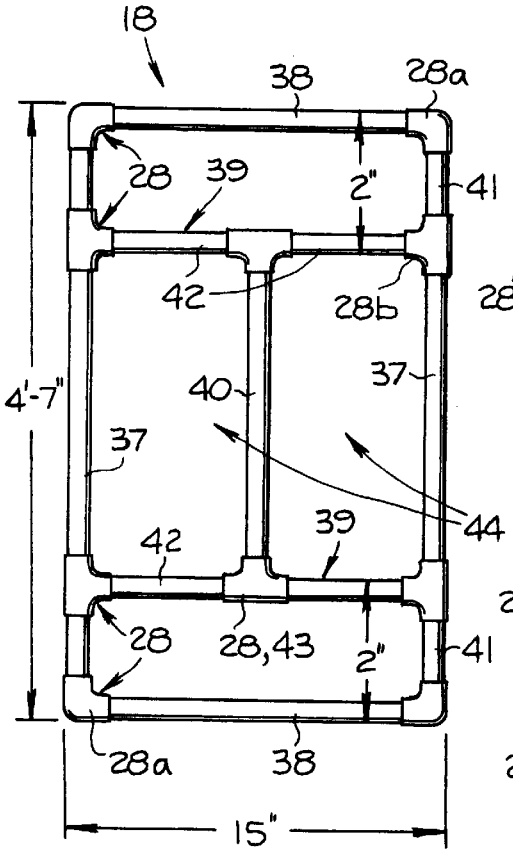
Fig. 3
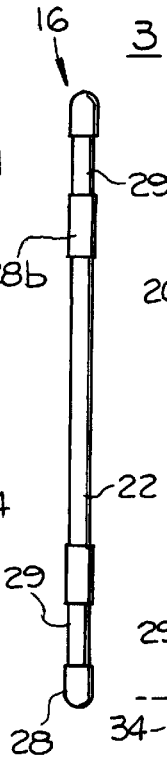
Fig. 1
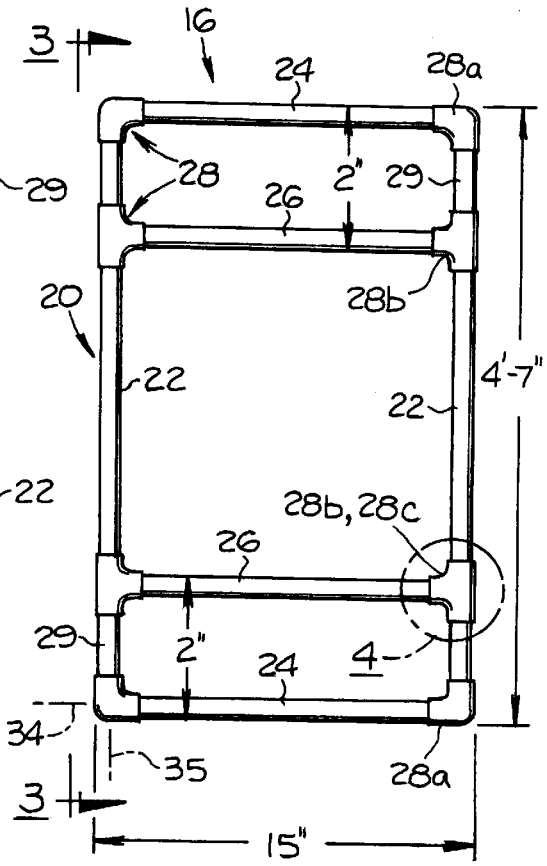
(4) 3/4" ELBOWS
(6) 3/4" TEES
(3) 4" LG. X 3/4" TUBES
(2) 12-1/2" LG. X 3/4" TUBES
(4) 6-1/4" LG. X 3/4" TUBES
(4) 1-1/2" LG. X 3/4" TUBES
(2) 4' LG. X 3/4" TUBES
(4) 12" LG. X 3/4" TUBES
(4) 3/4" ELBOWS
(4) 3/4" TEES
(4) 1-1/2" LG. X 3/4" TUBES
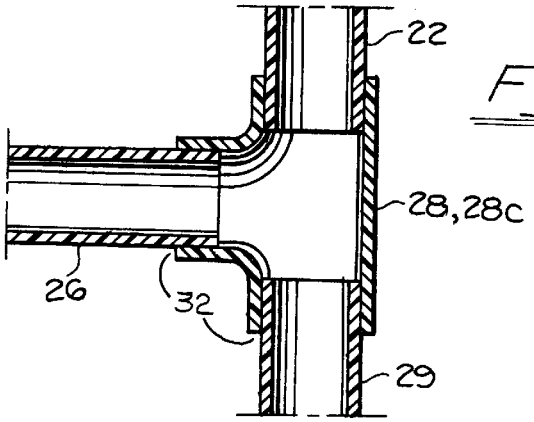
Fig. 4

ROLL-BACK EXERCISER

SUMMARY OF THE INVENTION

The invention resides in the general field of physical exercise, and more particularly relates to a device that not only improves the physical condition of the user but also the mind and spirit. In the use of the device, the user produces an advancing exertion in which he tenses his muscles, and upon relaxing his muscles, the device produces a roll-back action, that is, it urges or biases the arms, and actually the body, back to an original or neutral condition or attitude. In this step of the activity, it produces what is in effect a pulling and pushing action. It responds to the movements of the arms, and in the transition between opposite movements of the arms, it develops an angle of bending that results in gentle motion of the arms and body.

A principal feature of the invention is to provide a simple device, that is extremely simple both in the materials used and in the steps of fabrication. Moreover, it has such shape, and overall dimensions, as to render it easily handled and manipulated, in any of various positions or attitudes of the body of the user. The effect in the muscles other than in the arms is brought about by overall movement of the body.

Another principal feature is to provide such a device that its extreme simplicity makes it very easy to use, and when not in use it occupies a very small space and is easily put in reserve position, or stored.

Still another important feature is to provide such a device that is quite rigid, but with limited flexibility, which is self-biased to a flat position or condition, and easily establishes a zero position from which all exercising movements are related.

Another important feature is that the device is made up of standard items or pieces, that are readily available on the market, and they are put together to form the final device in an operation that is simple and known.

BRIEF DESCRIPTION OF THE INDIVIDUAL FIGURES OF THE DRAWINGS

FIG. 1 is a face view of the device of the invention, with a list of the elements making it up.

FIG. 2 is a face view of an alternate form of device, oriented according to FIG. 1, with a list of the elements making it up.

FIG. 3 is an edge view taken at line 3—3 of FIG. 1.

FIG. 4 is a large scale cross sectional view of one of the connections of the device, enclosed in the circle 4 of FIG. 1.

FIG. 6 is a front view of a user holding the device in its normal, full length position.

FIG. 7 is a top view of FIG. 6.

FIG. 8 is a view oriented according to FIG. 7 but showing the device in bent form.

FIG. 9 is a top view of a user holding the device in position behind his back.

FIG. 10 is a view of two of the devices, of the two different kinds, in position for simultaneous joint action by two users.

FIG. 11 is a view oriented from the top of FIG. 10, but showing the two devices in bent form with the elements thereof intermeshed.

DETAILED DESCRIPTION OF THE DRAWINGS

Figure 6:
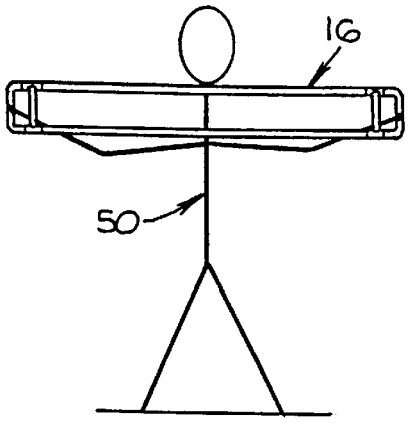
FIGS. 6–11 are diagrammatic views of the device in use, certain of the figures including the user.

Referring to the drawings in detail, attention is directed first to FIGS. 1–3 to show the overall nature of the device. FIG. 1 shows one form of device 16, and FIG. 2 shows an alternate form 18. These two forms are similar in overall construction but contain detail differences as will be described hereinbelow.

While FIG. 3 is an edge view of the device of FIG. 1, it represents each of the forms of FIGS. 1 and 2.

The exerciser or device 16 of FIG. 1 is in the form of a rectangular frame 20 which includes a pair of longitudinal side members 22 and transverse end members 24. The frame includes additional transverse members 26 adjacent the ends, parallel to and spaced a small distance from the respective members 24. These transverse members 26 are generally similar to the end members 24, and the double members 24, 26 at each end provide additional structure for stability and strength. The scope of the invention is sufficiently broad to generally cover a frame with only one end member (24) at each end if it should be desired to so construct it, although the preferred construction is that with the double members.

The side members 22 and the end members 24, 26 are all of tubing, and individually may be identified as tubes or tubing segments.

The frame includes connectors or connector elements identified broadly as 28, but including specifically elbows 28*a* and tees 28*b*.

Between the end members 24, 26, at each end, and between the corresponding elbows and tees, short tubes 29 are utilized.

The side members 22 and the end members 24, 26, and short tubes 29 may also be referred to as linear elements and they are connected together by the connectors 28. The connectors as is known, in this kind of construction, are tubular in construction. The elbows are utilized for connecting the ends of two adjacent tubes together, while the tees are utilized for connecting the ends of three adjacent tubes. The aggregate tubing from which the tubes are cut is produced by extrusion, and the connectors by molding.

The linear elements, or tubes, are of certain predetermined lengths, and reference to this feature will be referred to again in comparison of the two forms of FIGS. 1 and 3.

The side members or tubes 22 extend the greater part of the length of the frame, i.e. less the spacing between the adjacent end members 24, 26, and constitute the principal strength of the frame, but the short tubes 29 do add a certain amount to the length and strength of the frame. The side members may be considered, for practical purposes, and in interpreting the claims, as functionally essentially the length of the frame.

All of the linear elements and connectors are telescoped respectively, and held together by a glue. The device is therefore made up solely of the linear elements and connectors and the glue.

FIG. 4 is a large scale, cross sectional view of that portion of the device or frame enclosed in the circle 4 of FIG. 1, which includes the corresponding linear elements 22, 29, and the transverse member 26. The enclosed connector 28 is a tee, and is individually identified 28*c*.

The glued surfaces between the linear elements and connectors appear at 32.

Each device 16 lies in an essentially common plane (FIG. 4). Regarding such a plane, the thickness of the frame is not considered, the plane being referred to is as determined by the axes 34 and 35 (FIG. 1), which are the longitudinal central axes of the corresponding mutually transverse linear elements. The device so lying in a common plane, forms opposite flat faces.

Figure 5:
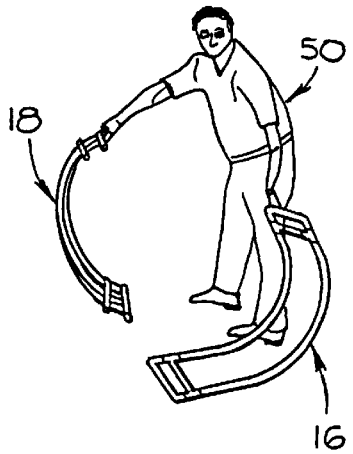
FIG. 5 shows the two forms of device, held by a user in demonstrable position.

Reference is made to FIG. 5 showing the devices 16, 18 held by a user 50, this illustration clearly depicting their overall nature.

The linear elements and the connectors are made of plastic. The linear elements are relatively rigid so as to produce a rigid frame, but the plastic material does have a limited amount of flexibility, so as to enable the linear pieces to flex or bend, particularly the long side pieces 22, as referred to below.

An example of the tubing utilized, and satisfactory for the purpose is that identified as (CTS) portable tubing—SDR—9, 15 Plasco Ultral—Pex. The invention of course is not limited to that specific material, and others having the desired strength and rigidity and limited flexibility may be used instead, if desired. The connectors, as noted, are molded, and may be of a desired plastic material. The glue securing the various elements together may be of any known kind that is effective for bonding the plastic elements and securing them together, as is known in the trade.

Figure 8:
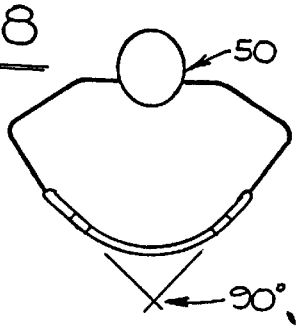

The flexibility takes place principally in the long pieces, i.e. the side members 22, but the corner elbows although of plastic material similar to that of the other pieces may be considered rigid, and therefore the frame is normally retained in rectangular shape. The linear elements are originally straight, being self-biased to that shape, thereby maintaining the entire device in flat position, in the absence of applied external forces. The flexibility of the side members is of the essence of the device, and those members can be bent a substantial extent, such as to be contained within an angle as small as 90°, as indicated in FIG. 8. The end members 24, 26 may of course flex somewhat but they may be considered as being rigid from a practical standpoint, in the use of the device.

The second or alternate form of device, shown in FIG. 2 and designated 18, is generally similar to the first form of device, in that it includes side members 37, and end members 38, 39 corresponding with the members 22, 24, 26 of the first form, but it also includes an additional longitudinal intermediate or middle member 40. The intermediate member 40 is connected at its ends with the end members 39, the latter being spaced from the end members 38 as in the form of FIG. 1, by short tubes 41 similar to the tubes 29. The end members 39 are each made up of a pair of transversely aligned tubes 42 interconnected by a tee 43.

The two forms of the device are preferably of the same outline size, and of the dimensions indicated in the tables associated with the figures. The device of the second form is stronger, having three longitudinal linear elements (37, 40) instead of two in the first form (16), and thus results in greater exercising forces. The devices are not limited to the particular sizes disclosed and may be of other sizes, main consideration being that they be of a suitable length to be held by the arms in more or less outstretched position. As constructed as disclosed herein, the first form weighs approximately 2 lbs., and the second form approximately 2 lbs., 5 oz.

A great feature of the invention is that many of the elements making up the devices are identical and can be used with either form. The side linear elements 22, 37 of the two forms are identical; all the end members 24, 26, 38 are identical; and the short tubes 29, 41 are identical. Also, all the elbows are identical, as are the tees.

Figure 7:
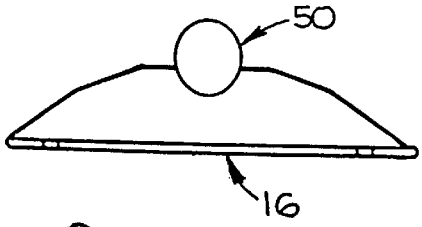

Reference is now directed to FIGS. 6–8, which are diagrammatic in nature and represent the movements of the user of the device in exercising. In FIG. 6, the user 50 grasps the device 16 with arms outstretched. This same position is shown in FIG. 7, which is a view from the top. One exercising movement in this step, is to bend the device, moving the ends inwardly toward each other, the central part being curved or bowed forwardly as indicated in FIG. 8. As noted it can be bowed into a position contained within an angle of 90°, this angle being an example, and not limiting.

For facilitating consideration of the rigidity/flexibility of the frame, attention is directed to FIGS. 1 and 3, showing the dimensions and proportions. These sizes and proportions have proved to be satisfactory, although the invention is not limited to those precise measurements.

Figure 9:
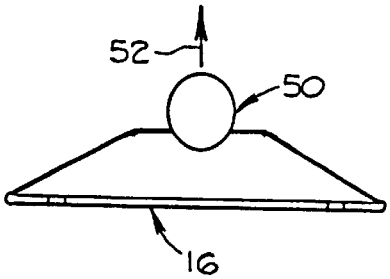

The device may be used in any of various other positions. FIG. 9 shows the user 50 holding the device 16 behind him, the arrow 52 indicating forward direction. The device is then bent or bowed in a manner as described above, but in holding it behind himself, he exercises muscles different from those in other positions. It is also practical and beneficial to hold the device in still other positions, such as below and between the legs, above the head, and in other positions resulting from twisting the body so that, even though the main exercising is in the muscles of the arms, nevertheless in the different positions of the body the various body muscles are exercised in different ways.

Figure 11:
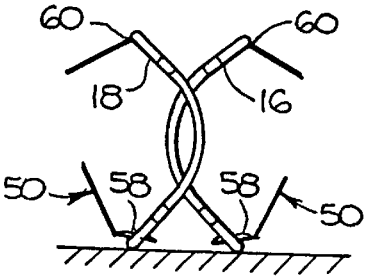
Figure 10:
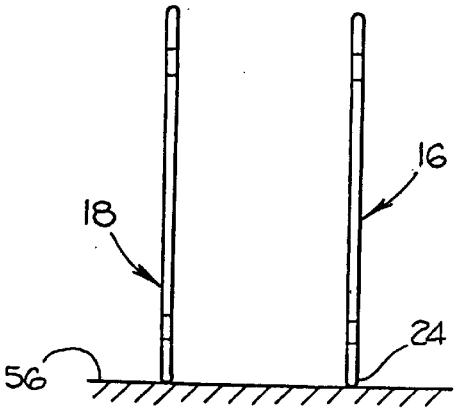

Referring to FIGS. 10–11, and as referred to above, two users may cooperate in exercising, to stimulate interest. In this case the users use the two different forms 16, 18, of FIGS. 1 and 2. In FIG. 10 the two devices 16, 18 are shown set up on the end edge, on a floor 56, a short distance apart, and in face-to-face position. The users 50 are indicated (FIG. 11), and the foot 58 of each may be placed on the lower end member. Also as indicated in this figure, the users grasp the upper end of the devices as indicated at 60. They bend the devices and move the upper ends downwardly, with the central parts bowing toward each other.

In so bending and bowing the devices, the longitudinal linear elements of each move into the spaces between the linear elements of the other device, or outwardly, beside them, at the side edges.

In this step in using the devices, by a pair of users, the exercising effect is considered greater in that the coordinated or synchronizing movements increase the interest in the exercising movements.

The alternate device 18 (FIG. 2) may be of course used alone or independently, instead of the device 16, if desired. The device 18 having three longitudinal members possesses greater rigidity, and resistance to bending, as noted, but either of the devices may be made of any of various sizes, and as to two or three longitudinal members, according to the desire for greater or lesser pressure to be imposed in the exercising.

Even in the case where a person wishes to exercise solely, he may do so in the activity represented in FIGS. 10–11, that is, standing and placing one end of the device on the floor and grasping the upper end and bending it. In this exercise the effect on the muscles of the arm are different from that in the other steps, in that the arms are moving in different directions, but it also produces a good effect on other muscles of the body, in that the body is bent in exercising in this manner.

The user may wish to assume a sitting position, and this is also convenient and beneficial. Instead of standing while bending the device as represented in FIG. 11, he may be seated and this will produce an effect on still different muscles of the body.

In line with the simplicity and inexpensiveness of the device, it is stated that the linear elements and connectors are of standard nature and readily accessible on the market, as is the glue. In fabricating the device it is only necessary to obtain an aggregate of linear tubing and cut it into the desired lengths according to their positions in the frame, and fit them in and glue them to the connectors. All of the elements are priced competitively in the market, and the steps in actually cutting the linear pieces and fitting them together is inexpensive.

The device is compact and of clean design, without protuberances or loose parts. Hence it is unitary and effectively integral. It is small of volume and can be easily fitted into small crevice like spaces for storing.

I claim:

1. A roll-back exerciser comprising, a frame including longitudinal side members and transverse end members, connectors interconnecting the side members and end members, the side members extending nearly the length of the frame, the frame having a rectangular shape, as determined by the side members and end members and connectors, and contained entirely within that rectangular shape without any elements laterally outwardly therebeyond, said side members and end members being generally rigid and thereby biasing the frame to an original shape in which all the members lie essentially in a common plane, and in the absence of applied external force moving it into and maintaining it in that plane, but having a limited degree of flexibility, the end members constituting handles for gripping by the hands of the user, whereby the exerciser is adapted to have sufficient flexibility to enable a user to bend the frame about axes extending across the lesser dimension of the rectangle, into an arc contained in an angle at least as small as approximately 90°, all of the side members and end member being straight, and of tubular shape, the connectors being of tubular shape, all of the side members and end members being individually rigid, and the end members including two at each end of the frame, an outer end member and an inner end member, spaced apart longitudinally a small distance relative to the length of the frame.

2. An exerciser according to claim 1 wherein, the frame also includes a central longitudinal member extending between said inner end members, and inner connectors interconnecting the central longitudinal member with the inner end members, and the longitudinal member and inner connectors being of tubular construction and possessing the same rigidity of the remainder of the frame.

3. A roll-back exerciser comprising, a frame including longitudinal side members and transverse end members, connectors interconnecting the side members and end members, the side members extending nearly the length of the frame, the frame having a rectangular shape, as determined by the side members and end members and connectors, and contained entirely within that rectangular shape without any elements laterally outwardly therebeyond, said side members and end members being generally rigid and thereby biasing the frame to an original shape in which all the members lie essentially in a common plane, and in the absence of applied external force moving it into and maintaining it in that plane, but having a limited degree of flexibility, the end members constituting handles for gripping by the hands of the user, and whereby the exerciser is adapted to have sufficient flexibility to enable a user to bend the frame about axes extending across the lesser dimension of the rectangle, into an arc contained in an angle at least as small as approximately 90°, the frame is made up entirely of linear members and connectors, all of the linear members and connectors are made of plastic, all of the linear members are extruded pieces and thereby of uniform cross-section throughout their length, and all the connectors are molded articles, and the exerciser is made up solely of the linear pieces and the connectors and glue.

4. An exerciser according to claim 3 wherein, the exerciser is effectively of one-piece and rigid construction without protuberances or loose parts.

* * * * *